US005423130A

United States Patent [19]

Gallet

[11] Patent Number: 5,423,130

[45] Date of Patent: Jun. 13, 1995

[54] DEVICE FOR MOUNTING BALLSCREWS ENSURING THE CONTROL OF SEALING RACKS OF A FREEZE-DRYING TANK

[75] Inventor: Patrick Gallet, Mennecy, France

[73] Assignee: Societe D'Utilisation Scientifique et Industrielle du Froid-Usifroid, Maurepas, France

[21] Appl. No.: 78,085

[22] Filed: Jun. 18, 1993

[30] Foreign Application Priority Data

Jul. 2, 1992 [FR] France ..... 92 08147

[51] Int. Cl.[6] ..... F26B 25/00

[52] U.S. Cl. ..... 34/92; 34/242; 34/297

[58] Field of Search ..... 34/284, 297, 296, 242, 34/92, 406

[56] References Cited

U.S. PATENT DOCUMENTS 4,173,078 11/1979 Bird et al. .

FOREIGN PATENT DOCUMENTS 0399884 11/1990 European Pat. Off. .
2655020 5/1991 France .
17310 11/1916 United Kingdom .

*Primary Examiner*—Henry A. Bennet
*Attorney, Agent, or Firm*—Nikaido, Marmelstein, Murray & Oram

[57] ABSTRACT

The lower extremity of each ballscrew (4) is engaged in a nut (6) with a nil pitch equipped with horizontal and parallel throats (7) for receiving balls (8) which cooperate with grooves (9) provided in an extremity sleeve (10) borne by the screw. An imperviousness system is constituted by sintered stainless steel rings mounted onto the upper portion and lower portion of the sleeve and are kept in place by a profiled joint made of a flexible synthetic material.

9 Claims, 2 Drawing Sheets

DEVICE FOR MOUNTING BALLSCREWS ENSURING THE CONTROL OF SEALING RACKS OF A FREEZE-DRYING TANK

The invention concerns freeze-drying tanks and more particularly the special mounting of screwballs for controlling the sealing racks disposed in said tank.

So as to ensure that the frozen-dried products in a tank are not placed in contact with the ambient air, it is necessary to seal off the bottles containing the products in question, even inside the freeze-drying chamber. In order to achieve this aim, one advantageous technique consists of distributing said bottles on superimposed racks and do this in such a way that the latter are in turn placed in support on the bottles borne by the immediately lower rack and thus drive in their stoppers until all the racks are stacked and all the bottles are stopped up. So as to avoid the passages of control jack rods into the tank which generate the risk of dust or non-sterilized products entering inside, it is possible to use a mechanism for controlling these racks, thus avoiding any risk of contamination. The document FR-A 2 655 020 in the name of the Applicant concerns a mechanism for sealing bottles distributed on the racks of a freeze-drying tank whereby at least one of the racks is suspended from a sealing girder disposed horizontally inside and in the upper portion of the tank, said girder being moved from bottom to top or from top to bottom by at least two ballscrews extending vertically in the tank. A single external motor drives the screws in rotation and imperviousness is ensured more easily with the aid of joint holder sleeves.

These ballscrews which support the weight of the sealing girder, the racks and their load all need to be positioned extremely precisely and kept solidly in support on the bottom of the tank. In order to do this, it is normal practice to secure to the lower portion of each screw stainless steel rings intended to abut against bearings secured to the ring borne by at least two metallic supports anchored to the bottom of the tank. So that the rings rotating with the screw slide with as little as possible friction on the fixed bearings, these bearings are preferably coated with a ceramic powder charged with Teflon>.

The rings like the bearings are moved to support extremely large forces and, despite the precautions taken to ensure a perfect alignment of the screw in the bearings, the stainless steel rings and the friction materials do become worn, these rings and materials finding it difficult to support high pressures. In addition, this type of ring support is vulnerable to impurities and waste able to slide between the rings and with stress concentrations due to the slight plastic deformations of the tank during the temperature/pressure cycles, thus rapidly causing said rings to deteriorate.

These anomalies have led the Applicant to find a system for mounting ballscrews able to overcome said drawbacks, but one which easily facilitates mounting, dismounting and maintenance operations.

One main object of the present invention thus concerns a device for mounting ballscrews ensuring the control of racks supporting the bottles in a freeze-drying tank, said screws being in support at the bottom of the tank, a device by which the lower extremity of each screw is engaged in a nut with a nil pitch equipped with parallel and horizontal throats intended to receive balls cooperating with grooves provided in the screw, at least one imperviousness system being provided on both sides of the nut so as to prevent impurities entering between the screw and said nut.

According to the special characteristics of the invention, the lower extremity of the screw bears a sleeve in which said grooves are fitted and a nut is housed inside two hemispherical cages resting on brackets fixed to the bottom of the tank. In addition, openings are provided in the nut for placing the balls in the throats.

According to another main characteristic of the invention, the imperviousness system is constituted by sintered stainless steel rings mounted onto the upper portion and lower portion of the sleeve and the nut of the sealing girder by a profiled joint made of a flexible synthetic material.

Other particular characteristics and advantages of the invention shall appear more readily from a reading of the following description of one embodiment given by way of non-restrictive example with reference to the accompanying drawings on which :

Figure 1:
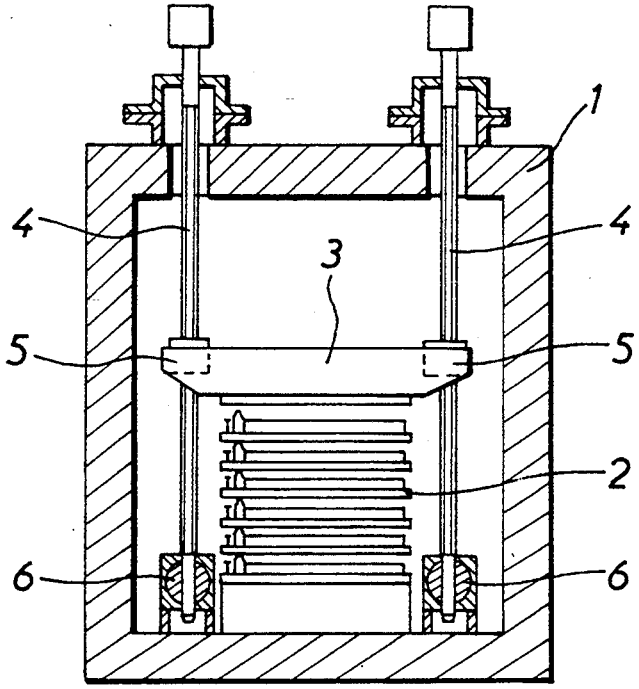
FIG. 1 is a diagrammatic cutaway view of a freeze-drying tank.
Figure 2:
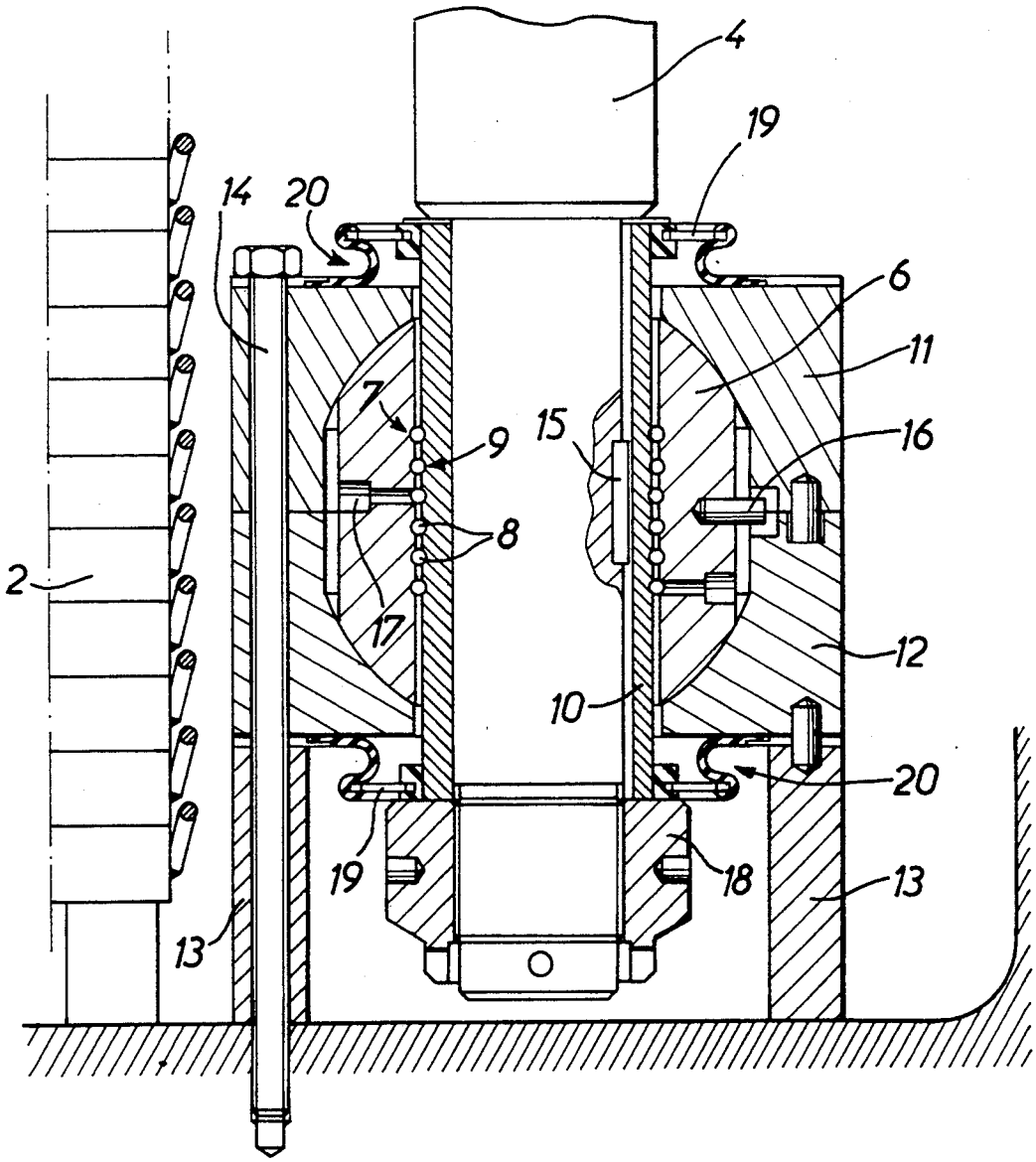
FIG. 2 is a cutaway view on larger scale of the mounting of the lower portion of the ballscrews.

The device shown on FIG. 1 is situated inside a freeze-drying tank 1 which contains a plurality of racks 2 moved by a sealing girder 3 in support on at least two ballscrews 4 by means of nuts 5. The screws extend vertically over the entire height of the tank on both sides of the racks. FIG. 2 shows in more detail that the lower extremity of each screw 4 is engaged in a nut 6 with a nil pitch, that is in a nut equipped with parallel horizontal throats 7 for each receiving several balls 8 which are also housed in corresponding cylindrical grooves 9 provided in an extremity sleeve 10 of said screw. The nut 6, whose outer shape is spherical and is able to act as a pot type joint so as to guarantee the optimal functioning conditions of the roller bearing without any parasitic stress, is housed inside two hemispherical cages (11, 12) resting on brackets 13, the entire unit being fixed to the bottom of the tank by a set of screws 14. The sleeve 10 is rendered integral with the screw 4 by a key 15. Secondly, a slug 16 ensures the link between the nut 6 and the cages (11, 12). Openings 17 (only one is shown) are provided in the nut allowing for placing of the balls in the throats 7. The lower portion of the screw 4 and the sleeve 10 ends by a fastening bolt 18. So as to ensure that impurities do not penetrate into the annular space between the nut and the sleeve, a sintered stainless steel filter ring 19 is mounted onto the upper portion and lower portion of the sleeve 10 against which it is kept in place by a profiled joint made of a flexible synthetic material. The filter rings are used to filter dust and impurities but are able to allow water vapour and gas to pass through enabling the mechanism to be degassed. The filter ring 19 disposed at the lower portion is situated in such a way that there is no possibility of condensation water accumulating, the latter naturally being evacuated during the vapour sterilization phase.

Figure 3:
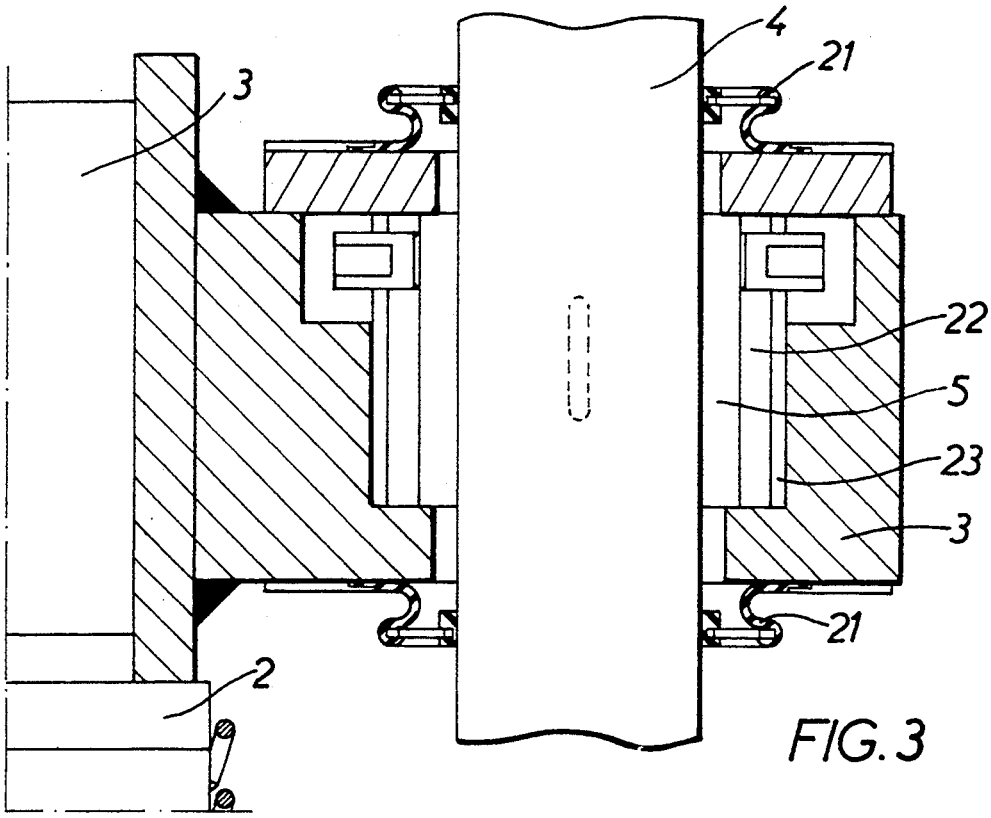
FIG. 3 is a cutaway view on larger scale of the nut of the sealing girder.

The upper portion of each ballscrew at the level of the sealing girder is shown in more detail on FIG. 3. This figure shows the nut 5 which tightens the ballscrew. The nut is rendered integral with the girder body 3 by a key system 22. It shall be observed that there is a space 23 between the nut and the girder body, said space constituting a slight play between the screw and the girder. This play authorizes a degree of displacement freedom of one of the mobile nuts 5 with respect to the sealing girder making it possible to absorb the differential cubic expansion between said girder and the rest of the tank. This figure also shows on both sides of the nut 5 that the sealing girder 3 is able to cooperate with the ballscrew 4 by means of a sintered stainless steel ring 19 supported by a profiled joint 21. The joint, by virtue of its shape adapted to the helical throat of the screw, is able to ensure protection despite the relative movement of the various components.

The nut 6 with a nil pitch defined earlier is easily interchanageable. Depending on the dimensions of the tank and the loads needing to be borne by the screw, the nut is equipped with a certain number of grooves containing a plurality of balls. It serves as a step bearing and, owing to the imperviousness means with which it is provided, is much less sensitive to abrasion.

I claim:

1. Device for mounting ballscrews ensuring the control of racks supporting bottles in a freeze-drying tank, said screws being in support at the bottom of the freeze-drying tank, wherein the lower extremity of each screw (4) is engaged in a nut (6) with a nil pitch and equipped with parallel horizontal throats (7) for receiving balls (8) cooperating with grooves (9) provided in the screw, and wherein at least one imperviousness system (19, 20) is provided on both sides of the nut so as to prevent impurities penetrating between the screw and said nut.

2. Mounting device according to claim 1, wherein the lower extremity of the screw (4) bears a sleeve (10) in which said grooves (9) are provided.

3. Mounting device according to claim 1, wherein the nut (6) is housed inside two hemispherical cages (11, 12) resting on brackets (13) fixed to the bottom of the tank.

4. Mounting device according to claim 2, wherein the sleeve (10) is rendered integral with the screw (4) by means of a key (15).

5. Mounting device according to claim 3, wherein a slug (16) ensures the link between the nut (6) and the cages (11, 12).

6. Mounting device according to claim 1, wherein openings (17) are provided in the nut (6) for placing the balls in the throats (7).

7. Mounting device according to claim 2, wherein the imperviousness system is constituted by sintered stainless steel rings (19) mounted on the upper portion and lower portion of the sleeve (10) and supported by a profiled joint (20) made of a flexible synthetic material.

8. Mounting device according to claim 7, wherein said imperviousness system (19) is mounted on both sides of the nut (5) of the sealing girder (3).

9. Mounting device according to claim 8, wherein a certain amount of play is provided between the nut and the sealing girder (3), thus authorizing a degree of displacement freedom making it possible to absorb the differential cubic expansion between said girder and the rest of the tank, and wherein a joint (21) has a shape adapted to the helical throat of the screw.

* * * * *